United States Patent [19]

Tabet

[11] 4,260,150

[45] Apr. 7, 1981

[54] WEIGHT FOR A BALL BAT

[76] Inventor: Michael A. Tabet, 1302 Pamela Pl., Norfolk, Va. 23518

[21] Appl. No.: 67,553

[22] Filed: Aug. 17, 1979

[51] Int. Cl.[3] ..... A63B 69/40

[52] U.S. Cl. ..... 273/26 B; 273/DIG. 8

[58] Field of Search ..... 273/26 R, 26 B, 29 A, 273/72 R, 194 B, 193 A, 171, 67 A; 272/117, 118, 119, 122, 123

[56] References Cited

U.S. PATENT DOCUMENTS

| | | | |
|---|---|---|---|
| 3,463,486 | 8/1969 | James, Jr. | 272/123 |
| 3,647,220 | 3/1972 | Burkhart | 273/194 B |
| 3,834,697 | 9/1974 | McNamara, Jr. | 273/67 A |

*Primary Examiner*—Richard C. Pinkham
*Assistant Examiner*—T. Brown
*Attorney, Agent, or Firm*—Stevens, Davis, Miller & Mosher

[57] ABSTRACT

A weight member to be mounted on a ball bat to be used in making practice swings prior to becoming a batter in a ball game, has two substantially symmetrical relatively dense members each having a hole therein aligned with the hole in the other for passage of a baseball bat therethrough. The members are fastened together in fixed spaced positions with an intermediate resilient member fixed in spaced relation with each of them and having a hole therethrough aligned with the holes in the dense members for passage of the bat therethrough and for frictionally engaging the bat to removably secure the weight member to the bat. The weight member can be mounted on the ball bat by pushing the handle-end of the bat through the holes in one of the dense members and the resilient member until the flanged-handle end of the bat is disposed below the resilient member, rotating the bat about a horizontal axis end-over-end until the weight member slides over the surface of the bat and becomes lodged where the handle flares outwardly into the hitting portion of the bat or on the hitting portion. The weight member is removed from the bat by rotating it end-over-end until the handle-end of the bat is below the hitting portion of the bat and the weight slides downwardly over the handle end.

13 Claims, 4 Drawing Figures

WEIGHT FOR A BALL BAT

This invention relates generally to equipment for a ball game and more particularly to an improved weight member for installation on a ball bat to be used for practice swings and to a method for positioning a weight member on a ball bat and for removing it from the bat.

The equipment required for playing a baseball game or the like includes a bat which is used to strike a ball thrown by a pitcher. The conventional ball bat is an elongated generally cylindrical implement of varying cross-section and is used by a batter to hit a ball thrown by another player known as a pitcher. The ball travels at a relatively high velocity as it approaches the batter and it is necessary for him to react quickly and swing through the path of the ball as it travels over the "plate". In order to adapt the muscles of the batter to react quickly and to swing the bat into the path of the ball, it has been the practice to swing a plurality of bats before taking a position in the batter's box. By taking practice swings with the heavier assembly of bats, the batter's arms tend to react more easily and to swing the single bat more quickly after all of the bats but one have been discarded.

In order to eliminate swinging of a plurality of bats which is awkward, it has been proposed to substitute a single weighted member in the shape of a ring or collar on a single bat for the extra bats. For example, a single ring having a frustoconically shaped cross-section is disclosed in U.S. Pat. No. 3,521,883. The ring has a hole therethrough for passage of the bat and is supported on the bat by friction or by circumferentially spaced set screws extending through radially extending holes in the ring member. Other types of weighted baseball bats are disclosed in U.S. Pat. Nos. 3,116,926; 3,136,546; 3,578,801 and 3,971,559. Weighting of the bat in accordance with the disclosures in these patents involves drilling a longitudinally extending bore in the bat and installing the weight in the bore permanently which, of course, results in the bat being unsuitable for hitting a baseball.

It is an object of this invention to provide a device for increasing the weight of a ball bat which is devoid of the foregoing disadvantages. Another object of the invention is to provide a device of higher density than that of a ball bat adapted to be removably mounted on a ball bat without excessive exertion for converting the bat into one which can be used for taking practice swings in preparation for assuming a position to attempt to hit a ball thrown by another. Still another object of the invention is to provide a ball bat and a substantially symmetrical member adapted to be mounted in surrounding association on a ball bat to increase the weight of the bat.

Other objects will become apparent from the following description with reference to the accompanying drawing wherein FIG. 1 is a plan view of one embodiment of a ring-shaped resilient member for removably fastening a weight member to a ball bat;

The foregoing objects and others which will become apparent from the description herein are accomplished in accordance with this invention, generally speaking, by providing a substantially symmetrical device having two rigid members of higher density than that of a conventional baseball bat and an intermediate resilient member, each having a hole therethrough, fixed together in face-to-face relation with the resilient member spaced from each of the rigid members and with the holes through the members being aligned with each other and adapted for passage of a bat therethrough with the resilient member frictionally engaging the surface of the bat and removably securing the device to the bat. The rigid members are preferably ring shaped but they may be square or polygonal or any other suitable shape which results in the weighted member being substantially symmetrical and the weight substantially uniformly distributed when the device is mounted in surrounding association on the bat. The bat can be made of any suitable material such as wood, aluminum, plastic or the like. The rigid members of the weight may be cast or molded of any castable or moldable material having a density higher than that of the bat such as, for example, iron, lead or other suitable metal, resin or the like. The rigid members are preferably encapsulated in a polymeric shell such as, for example, polyvinyl chloride, polyethylene, polyurethane, polyamide (nylon) or the like. The resilient member disposed between the rigid members of the weight may be any suitable flexible synthetic polymer such as polyvinyl chloride or the like but preferably polyurethane having a flexibility and hardness which adapt it to frictionally engage the bat and removably secure the weight member to the bat.

Figure 1:
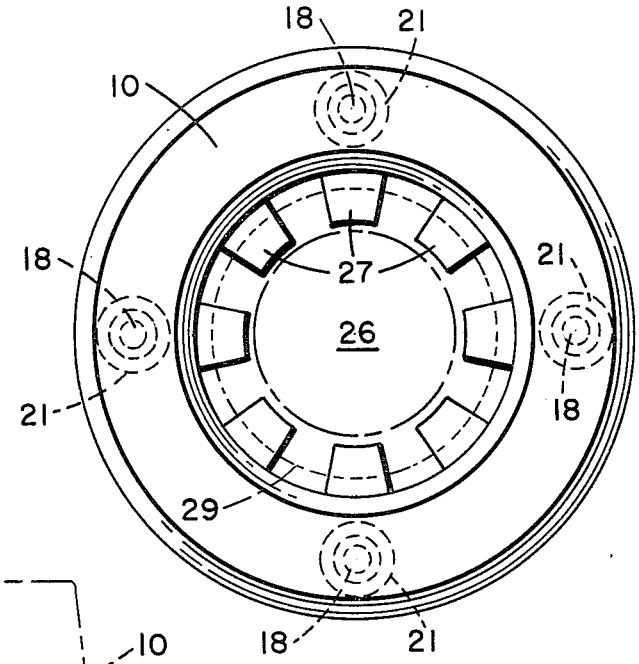
Figure 2:
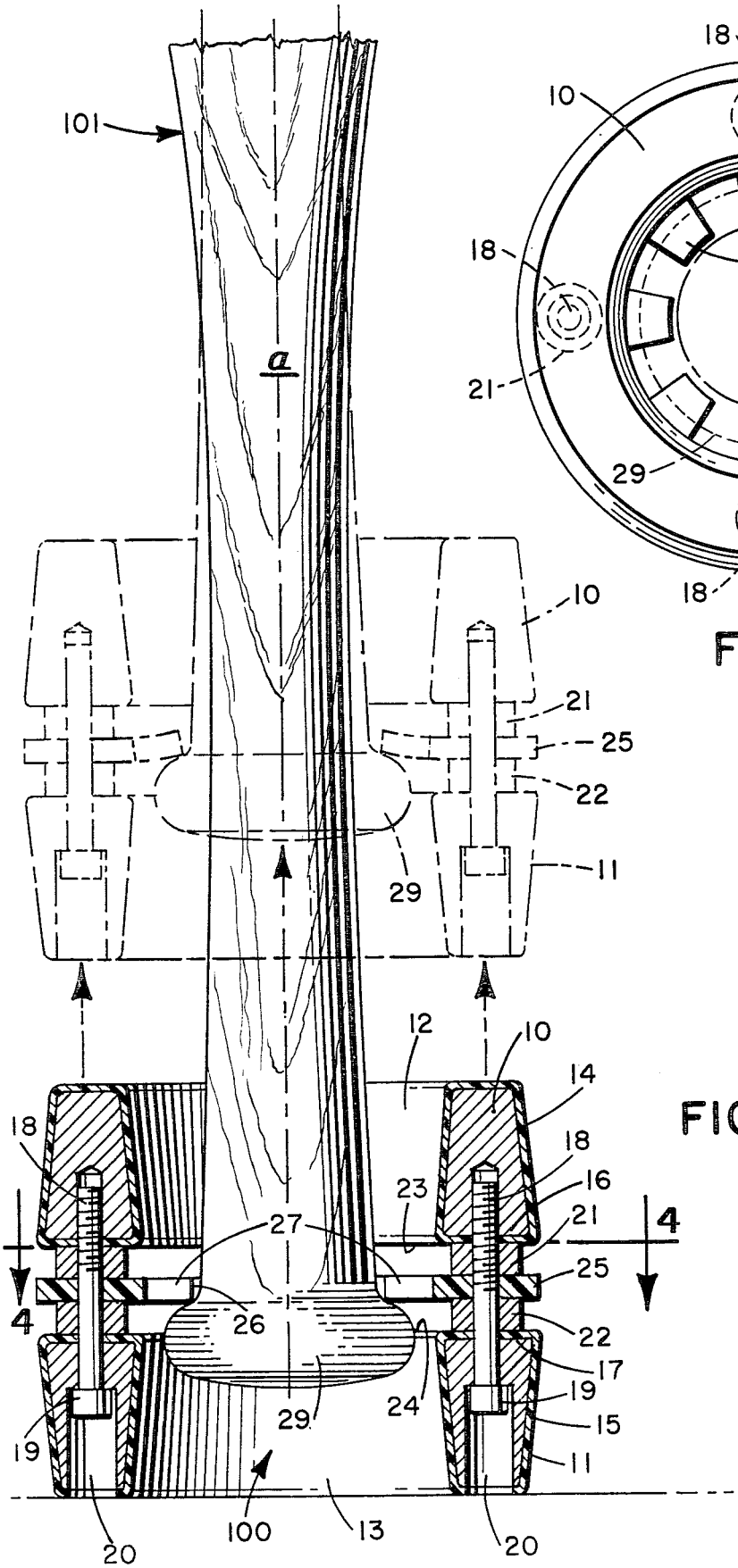
FIG. 2 is a fragmentary side elevation of the handle end of a baseball bat and an embodiment of a ring-shaped weight member disposed on the bat, the ring-shaped weight member is illustrated in section and also in phantom lines in a raised position.

Referring now to the drawing, one embodiment of the resilient member of the ball bat weight provided by the invention is illustrated in a plan view in FIG. 1 and in combined longitudinal section and phantom lined views in FIG. 2. As illustrated, the weight has two doughnut like ring members 10 and 11 disposed one above the other in face-to-face relation with aligned openings 12 and 13.

Ring members 10 and 11 are cast iron encapsulated in polyvinyl chloride polymer shells 14 and 15. These ring members have an inner surface surrounding a hole therethrough which is substantially nonyieldable and adapted to resist deformation by a bat or other object inserted in the hole. Ring members 10 and 11 are frusto-triangularly shaped in cross-sections and the bases 16 and 17 are secured in spaced relation by screws 18. The heads 19 of screws 18 are disposed in countersunk holes 20 originating at the frusto-apex of ring member 11. Screws 18 are secured in threaded holes in ring 10. Spacing washers 21 and 22 are disposed about the shanks of screws 18 and against the base surfaces 23 and 24 of ring members 10 and 11.

A resilient substantially nonporous polyurethane elastomeric ring member 25 has a centrally disposed opening 26 and is fixed in spaced relation between rigid ring members 10 and 11 against washers 21 and 22 by screws 18. Circumferentially spaced teeth or flaps 27 of ring member 25 provide an inner serrated edge which facilitates passage of a ball bat through opening 26 as illustrated in phantom in FIG. 2 to mount the weight 100 on the bat 101. The mass of weight 100 is distributed substantially symmetrically about the longitudinal axis "a" of the bat.

Figure 3:
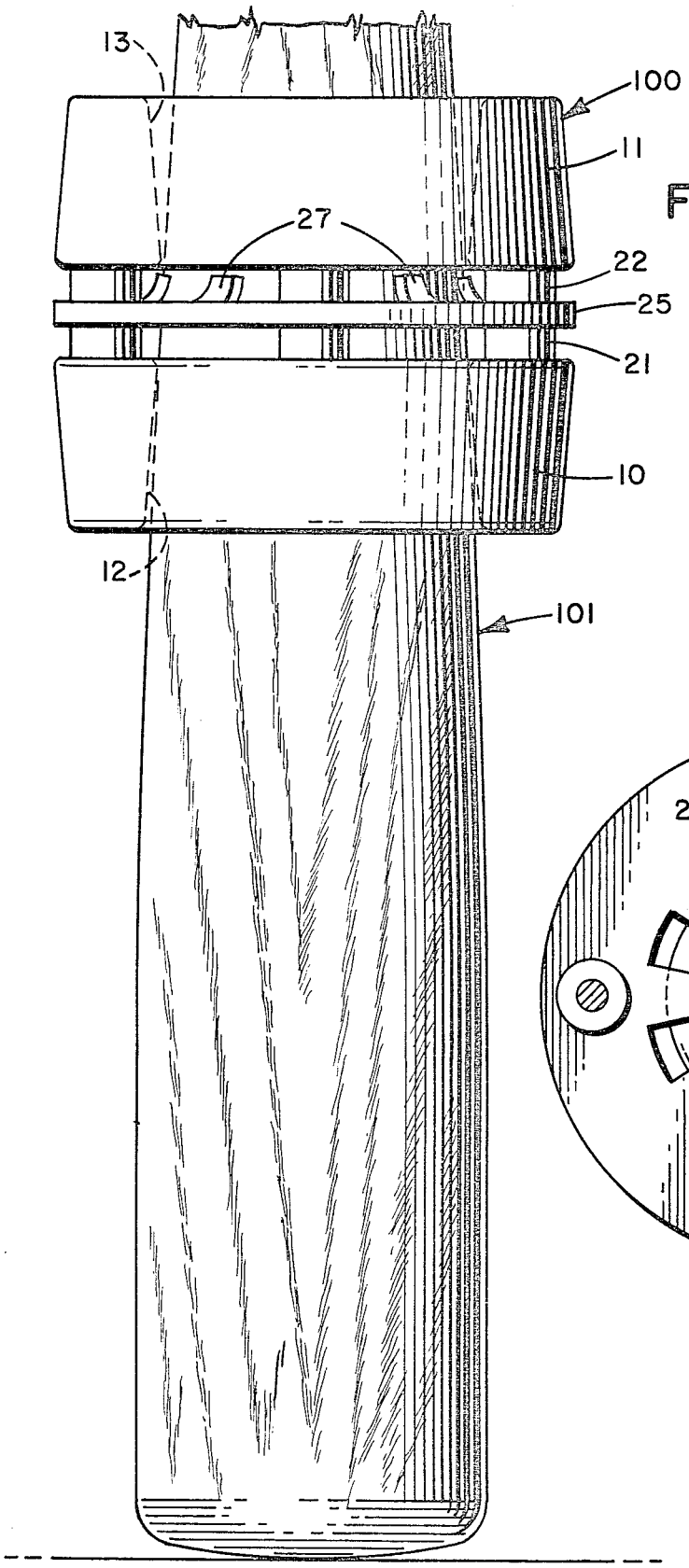
FIG. 3 illustrates in side elevation the weight member of FIG. 2 mounted on a ball bat shown in a fragmentary side elevation.
Figure 4:
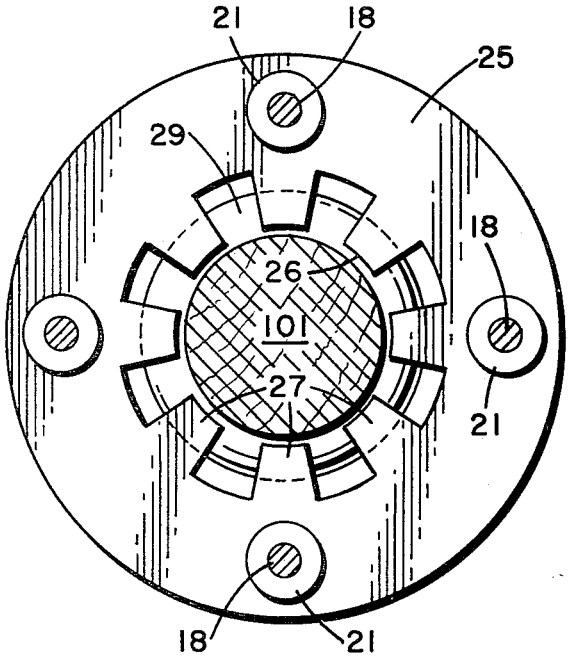
FIG. 4 is a sectional view of the assembly of FIG. 2 taken along the line 4—4 of FIG. 2.

One of the principal advantages of the weight member provided by this invention is that it can be mounted in place on the bat with a minimum of effort. The weight member may be resting on the ground or other surface with its open top or bottom facing upwardly and at a level near the level of the batter's feet. The weight member is mounted on the bat without the batter bending at the waist or stooping to pick up the weight member which is especially advantageous for one having a large waist line like that of the late George Herman "Babe" Ruth. To place the weight member on the bat, the weight member is disposed with one of its faces facing upwardly and the bat handle is forced through opening 26 in member 25 until flange 29 of the bat handle is disposed below member 25 as illustrated in FIG. 2. The bat is then rotated end-over-end whereby the weight member 100 will slide along the bat handle to a point on the bat where it flares outwardly to the bell portion of the bat as illustrated in FIG. 3. The weight member moves along the bat under centrifugal force towards its striking surface until it becomes firmly secured about the bat by centrifugal force as the batter swings. The smallest inner diameter of the weight 100 is such that is cannot slide off the end of the bat. To remove the weight member, the bat is turned to a handle-end down position. The weight member slides downwardly and off the bat over the flanged bat handle end. The sliding action may be initiated by striking the flanged end of the bat on the ground, if necessary.

This invention provides a bat and weight assembly for hitting a baseball, soft ball or other ball of the type conventionally struck by a batter.

Any suitable polyurethane may be used for making ring member 25 such as the substantially nonporous polyurethane elastomers disclosed by Saunders and Frisch in the two-book set of Vol. XVI *Polyurethanes: Chemistry and Technology* published by Interscience Publishers, copyright, 1964. One commercially available product which is particularly well suited for making ring member 25 is "Tool-A-Thane" urethane marketed by Urethane Tooling and Engineering Corporation, 16520 South Vincennes Avenue, South Holland, Illinois 60473. The polyurethane preferrably has a durometer of about Shore A 95, a tensile strength of about 5200 psi, an elongation of about 400%, a tear strength of about 150 ASTM D-470, lb/in. split or 600 ASTM D-624, lb/in., Die C, an abrasion resistance of NBS-275, a compression set of about 45%, Method B (22 hours at 158° F.), a resilience of about 40% (Yersley %) and a brittleness temperature of −90° F.

Although the invention has been described in detail for the purposes of illustration, it is to be understood that such detail is solely for the purpose of illustration and that variations can be made therein without departing from the spirit and scope of the invention except as it may be limited by the claims.

What is claimed is:

1. In combination, a baseball bat having a handle and integral therewith a ball-hitting portion, the maximum cross-section of which is larger than the maximum cross-section of the handle, said handle terminating at one end of the bat with an annular flange which provides a cross-sectional dimension larger than the maximum cross-section of the remainder of the handle and smaller than the maximum cross-section of the ball hitting portion of the bat, said bat flaring outwardly from the handle to the ball-hitting portion to provide a gradually increasing cross-section and a substantially smooth external surface at the juncture of the handle and ball-hitting portion, and a weight member having a higher density than that of the bat removably mounted on the bat for increasing the mass thereof, said weight member comprising substantially dense substantially symmetrical first and second ring shaped members, each having a hole therethrough for passage of the bat handle and for surrounding the bat when mounted thereon, said substantially dense first and second ring-shaped member being disposed in spaced relation with the hole in one substantially aligned with the hole in the other, the hole in each of the first and second ring-shaped members having a fixed minimum cross-sectional dimension which is larger than the cross-section of the bat handle, said weight having a substantially nonyieldable inner peripheral surface defining the hole therethrough, and a resilient member disposed between said first and second ring members in spaced relation with each of said first and second ring-shaped members, and means for securing said resilient member in said spaced relation, said resilient member having a hole therethrough which is substantially aligned with the holes in said first and second members and having a minimum cross-sectional dimension smaller than the maximum cross-section of the bat and adapted for the passage of said flanged end of the bat there through, whereby said weight is adapted to be positioned on the bat by supporting the weight with the aligned holes accessible by one end of the bat, inserting the said flanged end of the bat through the hole in one of the said first or second ring-shaped members and through the hole in the said resilient member, and rotating the bat end-over-end until the said ball-hitting portion is below the handle, whereby the weight moves towards the ball-hitting position and becomes lodged thereon when it reaches a bat cross-section which is too large to pass through the hole of the resilient member.

2. The combination of claim 1 wherein said resilient member of said weight member has an inner edge defining the hole therein comprising circumferentially spaced radially extending projections.

3. The combination of claim 2 wherein said resilient member is a flexible substantially nonporous polyurethane sheet.

4. The combination of claim 1 wherein the means for securing the said resilient member between said first and second members comprises circumferentially spaced screws having washers thereon to effect spacing of the resilient member from each of the said first and second members.

5. A weight member to be positioned on a baseball bat comprising two substantially dense first and second ring-shaped members, each having a hole therethrough for passage of a ball bat, means for fixing said first and second members together in spaced facing relation against relative movement, said holes through the first and second members being defined by a nonyieldable surface, and a resilient member fixed between said first and second members in spaced facing relation with each of the first and second members, and having a hole therethrough aligned with the holes in the first and second members, the cross-section of the hole in the resilient member being smaller than the maximum cross-section of the holes in the first and second members but large enough for passage of a bat's handle therethrough whereby the weight member is adapted for mounting on a conventional baseball bat by pushing the bat's handle end through the hole in one of the first or second members and the hole in the resilient member and rotating the bat end-over-end whereby the weight responds to gravity and moves over the bat handle until it becomes lodged on the bat.

6. The weight of claim 5 wherein the hole in the said resilient member is defined by a serrated inner edge of said resilient member.

7. The weight of claim 5 wherein the resilient member is a substantially nonporous polyurethane sheet.

8. The product of claim 1 or of claim 5 wherein the resilient member is a sheet of a synthetic resin.

9. The weight of claim 5 wherein the ring-shaped members are enclosed in a flexible shell.

10. In combination, a baseball bat and a device having a density greater than that of the bat removably fastened to the bat to increase the weight of the bat and adapt the bat for practice swings prior to batting, said baseball bat having a substantially cylindrical ball striking portion and a substantially cylindrical handle of smaller cross-section, said baseball bat flaring outwardly from a first end of the handle to the ball striking portion to provide a gradually increasing cross-section and a smooth tapering external surface, an annular flange around said handle at its second and free end to form a handle end of the bat of larger cross-section than the cross-section of the remainder of the handle but of smaller cross-section than the maximum cross-section of the said tapered portion between the handle and ball striking portions of the bat, said device comprising two members having an annular wall about a centrally disposed bore therethrough, said annular wall of each member having an inner surface about said bore which substantially fixes the cross-sectional dimension of the bore at a smaller dimension than the maximum cross-section of the said baseball bat and said annular wall of at least one of said members adapting the device to frictionally engage the surface of the bat while the device is mounted thereon, means fixing said members together in face-to-face relation with a space therebetween, and a resilient member having a hole therethrough fixed in said space and having a hole therethrough for passage of said flanged end of the bat therethrough but dimensioned to frictionally engage the bat on its tapered external surface and to prevent movement of the device from the bat under centrifugal force as the bat is swung in a circular path by its handle end.

11. A weight for mounting on a conventional baseball bat to increase the weight thereof, said weight having two ring-shaped rigid members having openings therein shaped to surround a bat, said members having a higher density than that of a baseball bat and fixed together with said openings aligned and with a space therebetween, and a resilient member disposed between the ring-shaped members in spaced relation with each of the ring-shaped members and having an opening therethrough to removably secure the weight to a ball bat.

12. The weight of claim 11 wherein the bat has a handle and a ball-hitting portion of larger cross-section than the handle, and the resilient member is a flexible sheet having a hole therethrough aligned with the openings in the ring-shaped members, said hole having a cross-section which permits passage of the flanged end of a baseball bat's handle but not the baseball bat's hitting portion.

13. A weight member for removable association with a ball bat to increase the weight thereof, said bat having a ball-striking portion and a substantially cylindrical handle integral at a first end with the said ball striking portion and of smaller cross-section than the ball striking portion to adapt it for gripping by a batter's hands, said bat flaring outwardly from the handle to the ball striking portion to provide an increasing cross-section and a smooth sloping external surface between the handle and ball-striking portion, said handle terminating at its second and free end which is also one end of the bat in an annular flanged end of smaller cross-section than the maximum cross-section of the ball-striking portion but of larger cross-section than the remainder of the handle, said weight member comprising two face-to-face ring-shaped members of greater density than the density of the bat and having aligned holes therethrough which have a cross-section larger than the maximum cross-section of said ball striking portion, means securing the rings together in spaced relationship, and a resilient ring member having a serrated inner surface fixed in the space between the said face-to-face ring-shaped members in spaced relationship with respect to each of the said face-to-face ring-shaped members, said serrated inner surface defining a hole through said resilient ring-shaped member adapted to fit snugly on said bat when the handle of the bat passes through the hole thereof with the resilient ring surrounding the bat thereby removably securing the weight member to the bat.

* * * * *